United States Patent [19]

Kulp et al.

[11] Patent Number: 4,475,101

[45] Date of Patent: Oct. 2, 1984

[54] TRAFFIC CONTROL DEVICE

[75] Inventors: Jack H. Kulp, San Juan Capistrano; Richard M. Cunningham, Huntington Beach, both of Calif.

[73] Assignee: Lear Siegler, Inc., Santa Monica, Calif.

[21] Appl. No.: 464,025

[22] Filed: Feb. 4, 1983

Related U.S. Application Data

[63] Continuation-in-part of Ser. No. 447,616, Dec. 7, 1982, abandoned.

[51] Int. Cl.[3] ..... E01F 9/00

[52] U.S. Cl. ..... 340/114 R; 340/114 B; 340/84; 340/87; 116/63 R; 116/DIG. 16; 40/557; 40/606; 40/612; 248/DIG. 10; 248/155.4; 248/548; 248/500; 229/41 R; 404/6

[58] Field of Search ..... 340/114 R, 114 B, 84, 340/87, 41 A, 45, 28, 983, 908; 116/63 R, 63 P; 63 C, 63 T, 203, 210, DIG. 8, DIG. 16, DIG. 40; 40/557, 571, 601, 606–612; 404/6; 248/155.4, 154, 158, 162.1, 528, 548, 636, 346, 347, 500, 503, 364, DIG. 10; 229/31 R, 31 FS, 32, 34 R, 34 B, 41 R

[56] References Cited

U.S. PATENT DOCUMENTS

| | | | |
|---|---|---|---|
| 1,750,319 | 3/1930 | Keith | 340/114 R |
| 3,738,309 | 6/1973 | Nichdl | 340/114 B |
| 4,083,033 | 4/1978 | Kulp et al. | 340/114 |
| 4,317,617 | 3/1982 | Charlton | 116/63 P |

FOREIGN PATENT DOCUMENTS

| | | | |
|---|---|---|---|
| 689072 | 6/1964 | Canada | 248/DIG. 10 |

OTHER PUBLICATIONS

"Flex-O-Lite" 6-17-82; Division of General Steel Ind. Inc.

*Primary Examiner*—Donnie L. Crosland
*Attorney, Agent, or Firm*—Edward J. DaRin

[57] ABSTRACT

A traffic control device constructed as a one-piece traffic channelizing device of a plastic material. The device includes a bottom having a plurality of flexible flap elements for receiving and storing a ballast thereon. The flexible flap elements are responsive to a substantial impact to the traffic control device to cause the ballast to be released from the flexible flaps while the device is impacted to a horizontal position adjacent its original position. The device is adapted to mount warning lights and to be stacked including with the warning lights mounted thereto. The stacking of the traffic control devices does not effect the desired action for the flexible flaps.

65 Claims, 13 Drawing Figures

WL
21
WL
21
WS
BS
20
~10~
WS
~10~
~10~
TC
~10~
~10~
B
11P
11P
11S
11
13
11
11S
4
4

TRAFFIC CONTROL DEVICE

This application is a continuation-in-part of our copending application bearing Ser. No. 447,616, filed Dec. 7, 1982, and entitled TRAFFIC CONTROL DEVICE and assigned to the same assignee as the present application now abandoned.

FIELD OF INVENTION

This invention relates to traffic control device and more particularly to traffic channelization elements presenting a formidable target to a motor vehicle operator.

BACKGROUND OF INVENTION

Traffic channelizers are traffic control devices presenting a formidable object to warn an operator of a motor vehicle of a hazard located on the nontraffic side of the channelizer and thereby signal to the motor vehicle operator that he should not proceed into the area beyond the traffic channelizing devices because of the hazard. Such traffic channelizers usually are approximately 36 inches in height and 18 inches wide to function as a formidable target to gain the attention of the motor vehicle operator. Metallic drums have been employed for this purpose. Traffic channelizing devices constructed of plastic to avoid the problems of metallic channelizing drums have been developed and are in use. One such plastic channelizer that has been widely utilized is disclosed in U.S. Pat. No. 4,083,033 granted on Apr. 4, 1978 and entitled "Traffic Control Element". One of the embodiments disclosed in U.S. Pat. No. 4,083,033 is a two-piece channelizing element that may be readily assembled together in a stabilized condition for traffic channelization purposes and yet the two pieces may be readily separated upon receiving a substantial impact by a motor vehicle or the like, to minimize damage to the traffic control element. In addition to the two-piece, plastic channelizing devices, one-piece plastic devices are presently in use. Present day one-piece devices generally have solid bottoms for storing stabilizing means such as a sandbag. All of the aforementioned traffic channelizers are adapted to mount a hazard warning light adjacent to the top thereof and are further adapted to be stackable.

Some uses of the one-piece plastic channelizers of the prior art have found them to be more convenient in use than a two-piece breakaway device, since some of these devices are provided with an open top that permits the open top to be readily grasped by an individual and allows the channelizing device to be dragged along the ground to a new channelizing position. In addition, some traffic channelizing devices permit the devices to be stacked, with or without the ballast stored therein, without the need to separate the top portion from the base portion for stacking purposes.

Present day plastic channelizers have been subjected to impact testing to determine their response to a substantial impact from the standpoint of the amount of damage caused by the impact, and the amount of displacement of the channelizers from the point of impact. One advantage of a one-piece, ballasted, traffic control device that was determined by the testing is a one-piece traffic channelizing element comes to rest more predictably near its original channelizing position. It was also determined that the point of impact and whether the channelizer had warning lights mounted thereon effects the trajectory and amount of displacement of the device and ultimately the final resting place. These tests further verified that the utilization of one or more flat sides prevented the traffic control devices from rolling beyond the flat side once the energy of impact is dissipated. The disadvantage that was revealed by the aforementioned testing was that the single piece or non-breakaway type of channelizing device was damaged more extensively with each impact than a two-piece channelizing device. It was also determined that it was more probable that the one-piece device would get tangled with the impacting motor vehicle to a greater extent than the two-piece device and present a danger to the motor vehicle operator.

SUMMARY OF INVENTION

The present invention provides an improved, inexpensive, one-piece traffic control device particularly adapted for traffic channelization that incorporates the advantageous features of a two-piece breakaway device; i.e., the ballast separates from the traffic control device upon substantial impact with the motor vehicle. The disclosed traffic control device is defined with a stepped configuration from end-to-end, with the smaller diameter adapted to be mounted on a supporting surface, while the larger diameter end is open-ended and is considered the free end. The smaller diameter end of the traffic channelizing device is provided with a plurality of flexible flap elements for releasably storing the ballast or stabilizing means to maintain the traffic control device in a stable position for traffic channelization purposes. The one-piece device is responsive to substantial impact from a motor vehicle or the like whereby the channelizer is separated from the ballast means. The flap elements after releasing the ballast means advantageously return to their original condition and position. The provision of a ballast storage means of the type disclosed herein at the bottom of the traffic control device allows the devices to be stacked without deforming the flexible elements during storage or stacking. The traffic control devices are advantageously constructed with warning light holding means that permit the traffic control devices to be stacked either with or without the warning lights mounted therein. The light wells per se are advantageously designed to mount warning lights in a nonrotatable position therein so that upon impacting the channelizer, the warning light will not, under normal vehicle impact, be ejected from the channelizer as a result of ripping through, or tearing through, the plastic wall or walls of light holders as prior art structures have responded. The traffic control devices are further provided with a roll resistant surface to prevent rolling along the ground until the energy that impacted it to a horizontal position is dissipated. The configuration of the device is preferably one having a curved surface in combination with a roll resistance surface to provide a continuous high target value to the motorist by means of the curved surface.

From a broad structural standpoint the present invention comprehends a traffic control device comprising a hollow element having a substantially closed end for mounting the element in a vertical position on the mounting surface when functioning as a traffic control element. The closed end is constructed and defined by means of a plurality of flexible flaps for releasably storing ballast means for stabilizing the hollow element in a vertical position when mounted on the flaps. The flaps are characterized as being responsive to an impact to the hollow element causing it to be moved from its vertical position to permit any ballast means stored on the flaps to substantially remain in position while being separated from the moving hollow element.

From a specific structural standpoint, the present invention comprehends a traffic channelizer comprising a hollow element having an outer configuration that is constructed and defined to be of a stepped configuration from the element mounting surface to the top surface thereof. The smaller dimension of the stepped hollow element has a substantially closed end for mounting the element in a vertical channelizing position on a mounting surface. The closed end is constructed and defined with a plurality of spaced, flexible, elements constructed integrally with the hollow element for substantially closing the bottom end of the hollow element. The flexible elements are adapted to receive means for stabilizing the traffic channelizer in a vertical position and being responsive to a substantial impact to the hollow element so as to release any stabilizing means therefrom while permitting the hollow element to be moved from its vertical position while being separated from the stabilizing means. The traffic channelizer includes means defined for mounting a warning light in the hollow element adjacent the top side thereof.

The spaced, flexible elements provided for the closed end of the aforementioned traffic channelizer are defined integrally with the hollow element to extend inwardly from adjacent the outer periphery of the closed end towards the center thereof. Each flexible element is spaced apart by radial slots extending between adjacent elements from adjacent the outer periphery of the closed end to a central aperture whereby the inner end of each element is spaced from the ends of each other element to permit each element to be independently flexible of the other elements.

BRIEF DESCRIPTION OF THE DRAWINGS

These and other features of the present invention may be more fully appreciated when considered in the light of the following specification and drawings in which.

DETAILED DESCRIPTION OF THE PREFERRED EMBODIMENT

Figure 1:
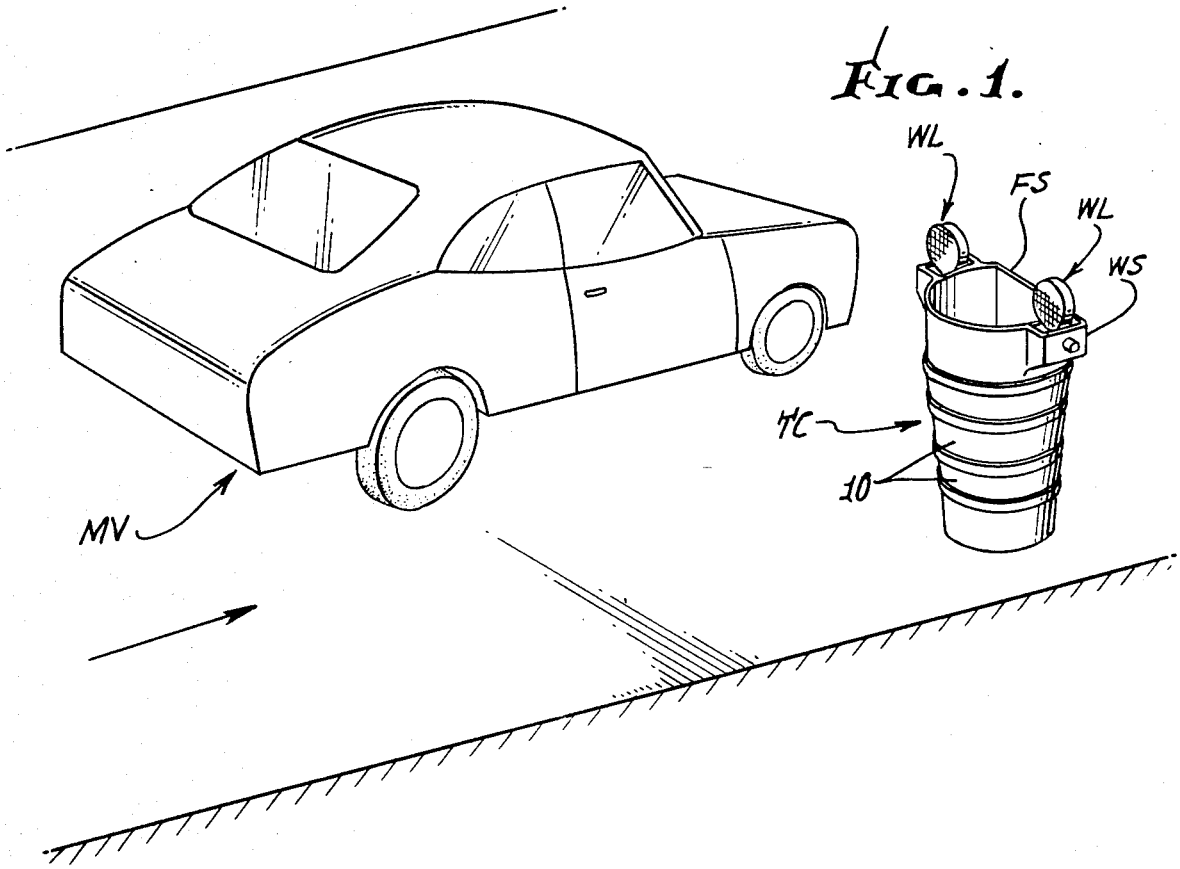
FIG. 1 is a diagrammatic representation of the motor vehicle traveling on a public highway illustrating the traffic control element of the present invention positioned on the highway for channelization purposes.
Figure 2:
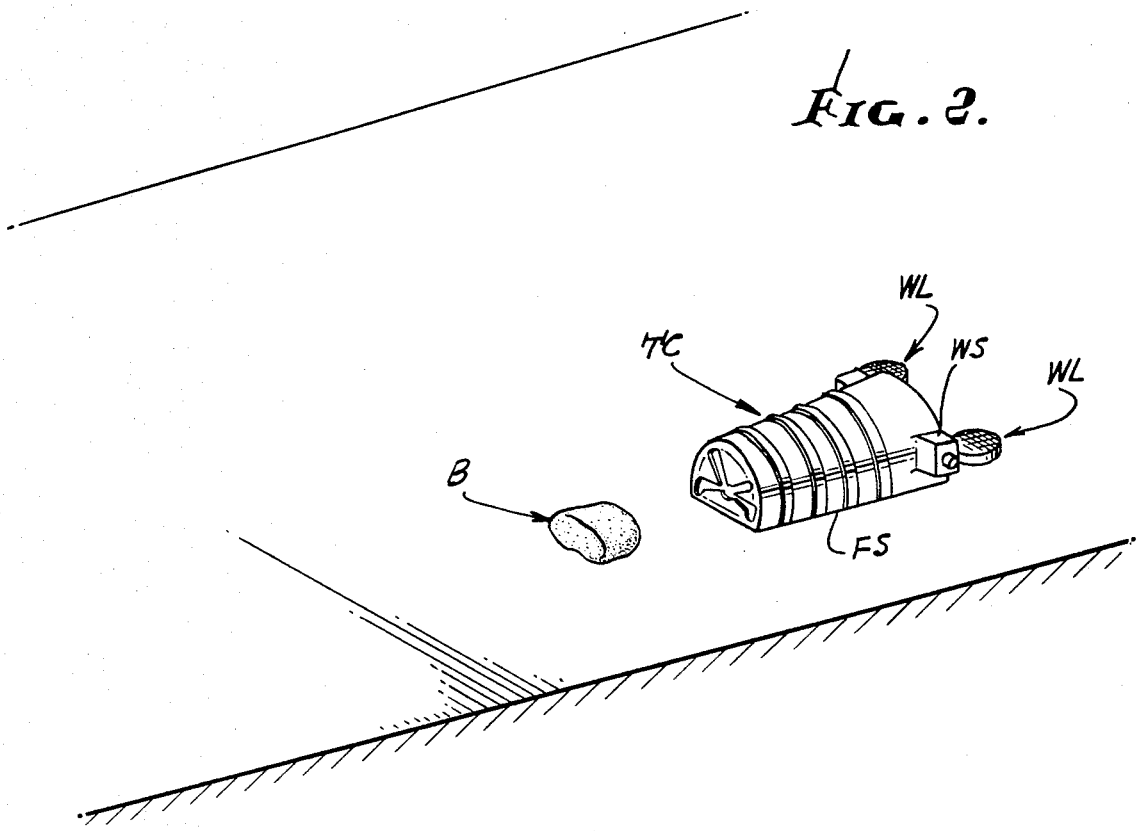
FIG. 2 is a representation of the traffic control element of FIG. 1 after it has been impacted by a motor vehicle and illustrates the separated ballast means and the traffic channelizer.

Now referring to the drawings, the traffic control element TC of the present invention will be described in detail. The traffic control element TC may be utilized in a variety of fashions for traffic control, delineation and/or channelization and is illustrated in FIG. 1 as it may be positioned on a highway adjacent the side of a traffic lane for traffic channelization purposes. In a number of applications of the traffic control device TC, a multiplicity of such devices may be arranged in alignment for a traffic channelization such as when it is desired to signal a hazard in a lane in which the motor vehicle MV is approaching and to cause the motorist to change lanes. The traffic channelizer TC is illustrated in FIG. 2 aftwer it has been impacted by the motor vehicle MV so as to cause the ballast B to be separated from the traffic control device TC proper. The traffic control device TC is preferably arranged with at least one flat side FS so that when the device TC is impacted to a horizontal position, the channelizer will come to rest on its flat side FS and prevent further movement of the traffic control device TC. Specifically, if a large truck or trailer-truck is moved at a relatively high speed past the traffic control device TC when it was in a horizontal position, the wind created by such high speed movement would not cause the traffic control device TC to respond to the wind but would be maintained in its impacted position as illustrated in FIG. 2, as contrasted with a circular configuration, for example, since a circular device will roll. The traffic control device TC, as illustrated in FIGS. 1 and 2, is shown mounting a pair of warning lights WL in each of the receptacles therefor. The warning lights WL are commercially available warning lights and are known in the art as a type A or C barricade light and are commercially available from the Signal Division of Lear Siegler, Inc. 1370 Esperanza Street, Los Angeles, Calif. It will be recognized that only one light may be mounted to the traffic control device TC under most circumstances. In many applications of the channelizing devices, the lights will be omitted in their entirety. The warning lights WL may be a steady burn light, Type C, or a flashing light, Type A, in accordance with the particular application and requirements of the governmental entity having jurisdiction over the road, highway or freeway.

The traffic control element TC has the general configuration of a barrel and therefore is adaptable to be used for the same general purposes as present day traffic channelizers of the type disclosed in U.S. Pat. No. 4,083,033 and may be used with the additional advantages and features described herein which are not comprehended by prior art traffic control devices. The general configuration of the traffic control device TC for the purposes of the present invention is that is preferably has an arcuate configuration with at least one flat side FS. The configuration may be considered as a generally D-shaped configuration in cross-section, as is evident from examining the drawings. The traffic control device TC may be defined to have one or two conventional warning lights WL mounted adjacent the top thereof for traffic warning and signaling purposes. The warning lights WL are preferably mounted and secured to the traffic control device TC in an anti-theft relationship. The warning lights WL are secured to the traffic control device TC by means of warning light sockets WS arranged on opposite sides of the traffic control device TC on the outside of the arcuate surface thereof.

In accordance with the present invention, the anti-rolling feature is improved relative to the traffic channelizers defined solely with roll resistant outer surfaces by the provision of the light sockets WS on the outside of the arcuate surface of the traffic control element TC. The light sockets WS per se act as roll resistant elements along with the flat side FS. When the warning lights WL are secured to the light sockets WS, the warning light lens 21 will further restrict the rolling of the traffic control element TC along with the light sockets WS.

The traffic control element TC is preferably constructed of a lightweight material such as a plastic end, in particular, a high molecular weight low density polyethylene material. A specific grade of polyethylene has been found to be satisfactory in that it has the required structural integrity at both high and low temperatures to be maintained in an upright position and is resilient enough not to be damaged as a result of minor impacts. The material permits any dents occurring in the material to be pushed back to its original condition by pushing the dented area outwardly to restore it to its molded shape. These properties allow the device TC to be reusable.

Figure 3:
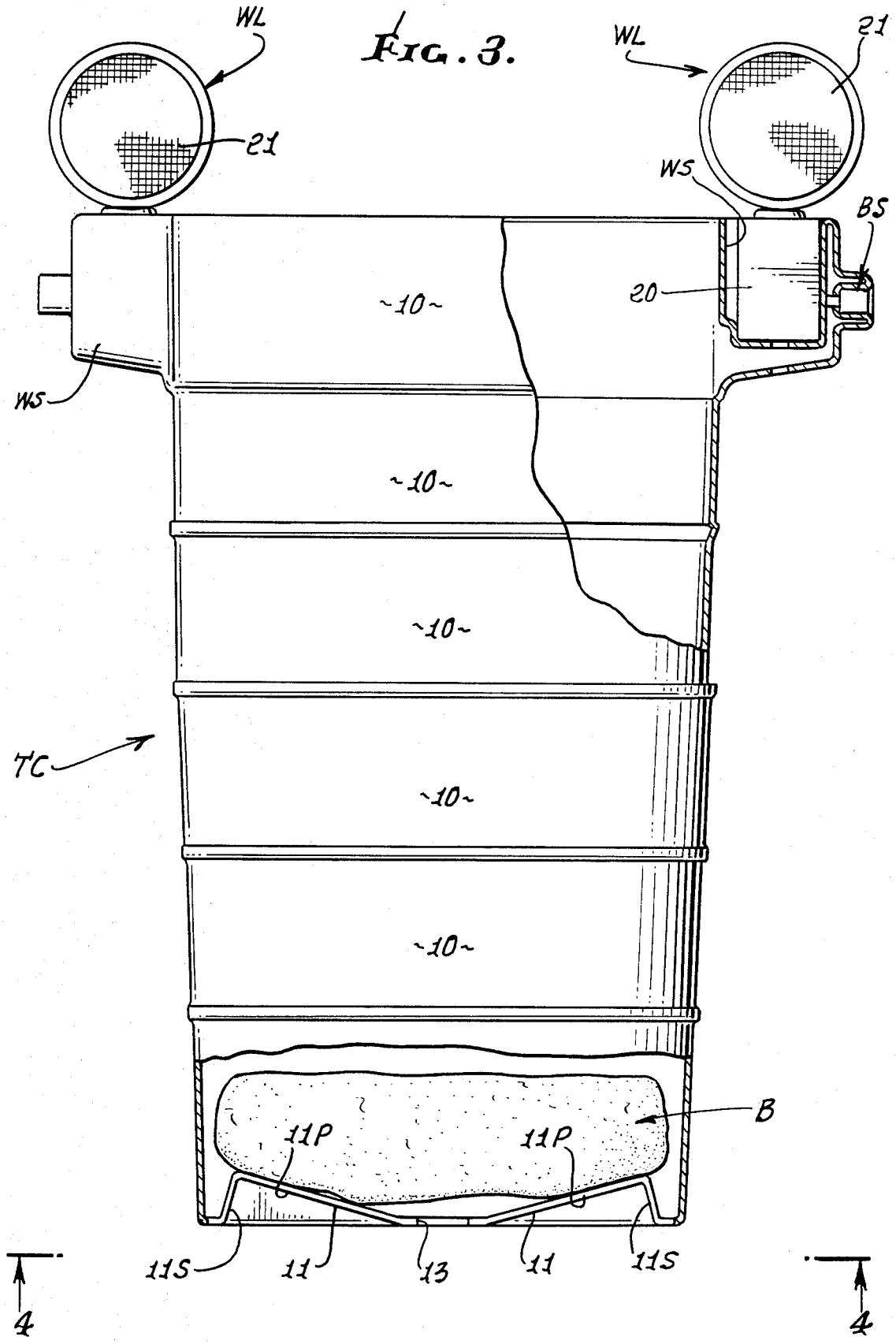
FIG. 3 is a front elevational view, with portions broken away and shown in section, of the traffic control device storing ballast means and embodying the present invention.

The specific configuration of the traffic control element TC is of a generally hollow, cylindrical configuration with a flat or planar area on one side, or the side identified as FS, thereby providing a generally D-shaped cross-sectional configuration for the element TC. The traffic control element TC is further defined to have a stepped configuration between its ends with the larger end being the free end with which the warning light sockets WS are integrally formed therewith. The smaller diameter end is the bottom end or the end normally resting on the supporting surface. The stepped configuration is defined to provide a plurality of arcuate sections 10 defined on the outer surface of the traffic control element TC of successively increasing diameter from the bottom end to the top end, as illustrated in FIG. 3. The arcuate sections 10 may be provided with surface areas that contrast in color with the basic color of the traffic control element TC proper. The contrasting color may be provided by means of commercially available sheeting secured to the treated outer surface of the traffic control element 10 by adhesives or the like. The commercially available sheeting secured to the traffic control element TC may also include reflective properties for nighttime use and the reflective sections may be arranged in a spaced apart relationship thereon. The reflective sheeting is not illustrated in the drawings.

An important feature of the present invention is the construction of the bottom end of the traffic control device TC for mounting and storing the ballast B which is illustrated in the form of a sandbag. The ballast B normally is stored on the bottom section of the traffic control device TC, as illustrated in FIG. 3. The enclosed end of the traffic control device TC is constructed and defined by means of a plurality of flexible flaps 11 and 12 for releasably storing ballast means B for stabilizing the traffic control TC in its vertical position when mounted on the flaps. The flaps 11 and 12 are characterized as being responsive to an impact to the traffic control device TC causing it to be moved off its vertical position to permit any ballast or sandbag B stored on the flaps 11 and 12 of the device TC to substantially remain in position while being separated from the moving hollow traffic channelizer TC; see FIG. 2.

Figure 4:
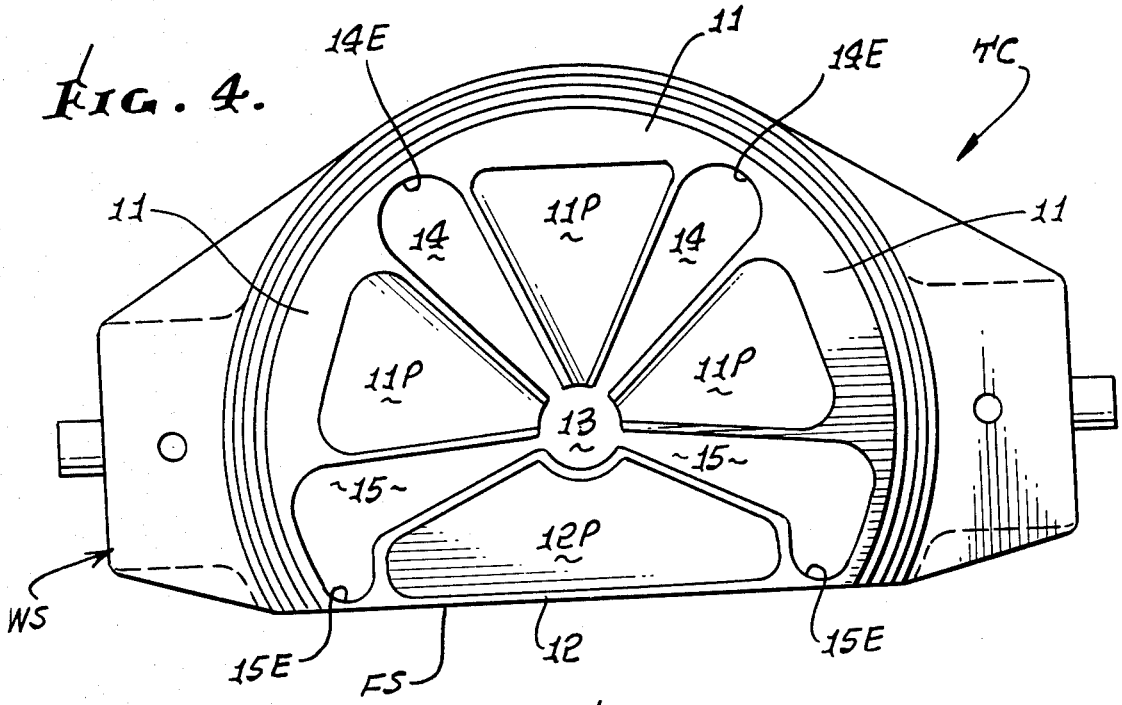
FIG. 4 is a cross-sectional view taken along the line 4—4 of FIG. 3.
Figure 6:
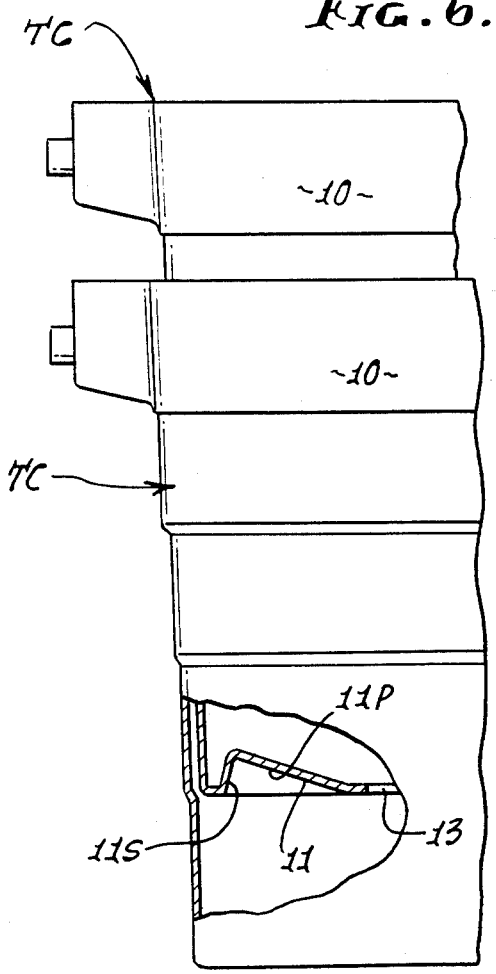
FIG. 6 is a front elevational view, with a portion broken away and illustrated in section, of a plurality of traffic control elements arranged in a stacked nested relationship after the warning lights have been removed therefrom.
Figure 8:
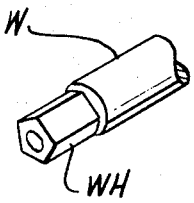
FIG. 8 is a partial, perspective end view of the operative end of the special wrench of FIG. 7.
Figure 9:
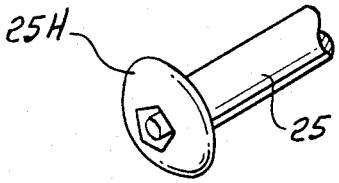
FIG. 9 is a partial, front perspective view of the bolt head for the securing bolt of FIG. 7.
Figure 11:
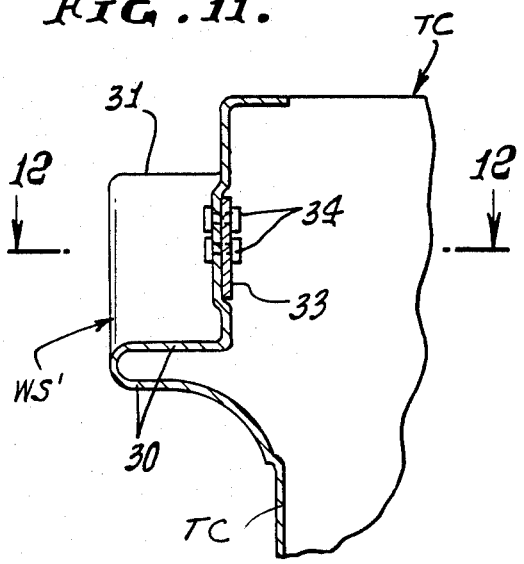
FIG. 11 is a partial cross-sectional view of the light holding means of FIG. 10, without a warning light secured thereto.

The construction of the flexible flaps 11 and 12 are integral with the traffic control device TC and can be best appreciated from examining FIGS. 3, 4, and 6. FIG. 4 in particular shows the detailed configuration of the flexible flap elements 11 and 12 for the purposes of the present invention. In the embodiment illustrated in FIG. 4, four flexible flaps are illustrated. The three flaps 11 are constructed integrally with the arcuate side of the traffic control device TC while the fourth flap 12 is attached to the device TC integrally adjacent to the flat side FS. The flap 12 is the sole flap attached to the flat side FS and extends between the ends of the flat side and radially toward a central aperture 13. Similarly, the elements 11 extend from adjacent the inner periphery of the curved portion of the device TC. Each of the flap elements 11 are spaced apart by radially extending slots 14. The slots 14 on the opposite side of the flap 12 are identified as slots 15 and have an enlarged end 15E. Similarly, the slots 14 and 15 have large releaf radii between the flap elements 11 and 12 and are identified by the reference numerals 14E and 15E. The large radius relief between the fingers 11 and 12 are provided to minimize notch sensitivity and the possibility of tearing the flaps 11 and 12 from the traffic control device TC, or tearing up the vertical wall of the traffic control device TC.

Flaps 11 and 12 are preferably constructed and defined so that they are substantially rigid for maintaining their relative horizontal positions, including when they are lifted off the ground or stacked, to prevent the elements 11 and 12 from drooping or taking a set. Specifically, the utilization of a single flap 12 opposite the flat side FS has been found advantageous for this purpose. The single flap 12 also provides additional rigidity to the large flat side, by helping to keep the flat side from bowing inwardly. To maintain the flaps 11 and 12 rigid and yet flexible, each of the elements 11 and 12 are constructed and defined to be raised inwardly and upwardly or stepped adjacent the periphery of the device TC by means of the flap portion 11S, such as illustrated in FIGS. 3 and 6 for the elements 11. The raised portions 11S of the elements 11, then, are inclined downwardly towards a central aperture 13. In this manner pockets 11P and 12P are defined on the bottom side of each of the flaps 11 and 12, as illustrated in FIG. 4. This construction has been found to give the flap elements 11 and 12 the necessary rigidity to maintain their essentially horizontal position when they are lifted off a supporting surface or when they are arranged in a stacked relationship, as illustrated in FIG. 6, and yet are sufficiently flexible to permit release of the ballast B.

Figure 7:
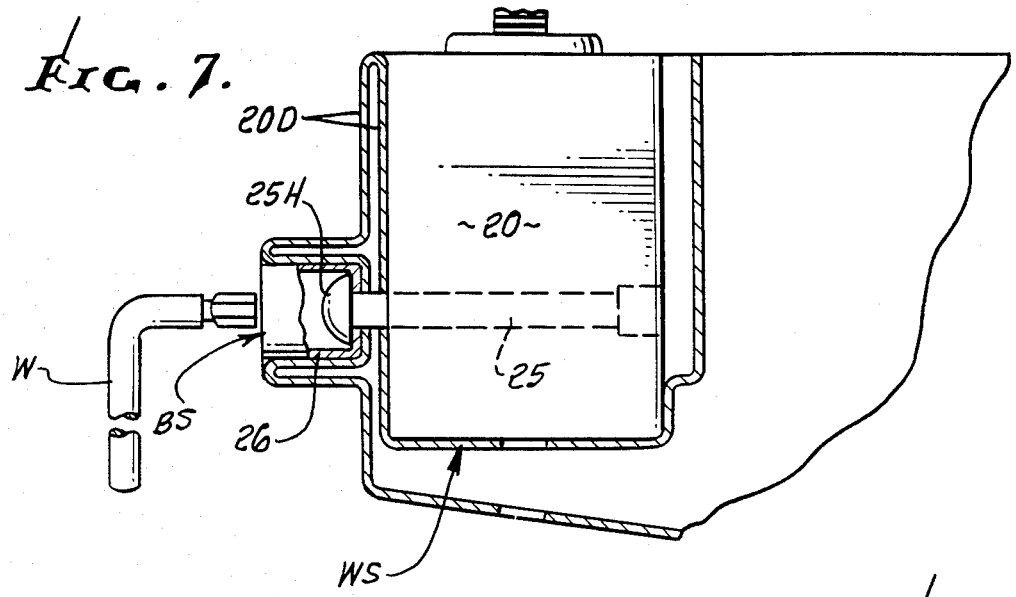
FIG. 7 is an enlarged cross-sectional view of the light holding means for the traffic control device of the present invention with a portion of a light illustrated mounted therein in an anti-theft relationship and showing a special wrench for removing the warning light in an exploded relationship therewith.

The upper portion of the traffic control device TC is constructed and defined with warning light holders or sockets WS constructed integrally therewith on the outside of the open end of the traffic control device and adjacent the top thereof. The light holding sockets WS ae defined to hold a warning light WS having a housing 20 with a plastic lens 21 extending outwardly from the top of the housing 20, as illustrated, for example, in FIG. 3. In accordance with the present invention, the light holding socket WS is defined to have a depth to substantially enclose the housing 20 with only the lens 21 extending outwardly therefrom; for example, see FIGS. 3 and 7. The light holding socket WS has its exterior wall constructed and defined by the double plastic wall 20D, and which double wall is formed with a bolt receiving socket BS; see FIG. 7. The light holding socket WS is illustrated in FIG. 7 with the retaining bolt shown in a secured, anti-theft, relationship with the warning light WL. To this end, it should be noted that, in conventional, commercially available warning lights WL that provisions are made for receiving a mounting bolt, such as the bolt 25, which is inserted through the socket BS and can be threaded into the housing 20 for securing the warning light WL to the traffic control device TC. To prevent ready theft of the warning lights WL from the traffic control device TC, the bolt 25, in addition to having a special configuration for the head 25H is provided with a protective cup 26 which has a central aperture to accommodate the shank of the bolt 25 and secures the head 25H. The protective cup 26 is defined to be essentially coextensive with the opening of the bolt socket BS, as illustrated in FIG. 7. The bolt 25 and cup 26 are of a commercially available construction and are similar to the anti-protective features disclosed in the prior U.S. Pat. No. 4,083,033 referenced hereinabove. The bolt 25 and the protective cup 26, however, in this instance, are completely enclosed within the socket BS. To secure the warning light WL to the traffic control device TC a special wrench W is required to rotate the bolt 25 in the housing 20 for securing the bolt to the traffic control device TC. Similarly, to permit an authorized individual to remove the warning light WL from the traffic control device TC, the wrench W must be employed. The wrench W has a head WH which has a complementary shape to the shape of the head 25H for the bolt 25 so as to permit it to engage the head 25H despite the presence of the protective cup 26 to allow authorized access to the bolt head 25H and the removal of the warning light WL. The construction of the warning light socket WS in this fashion for accommodating the housing 20 for the light WL minimizes theft of the warning light. Also, the warning light WL is protected during impact of the traffic control device TC and permits stacking of the traffic control devices TC with the warning lights WL installed in the socket WS, as will be described hereinafter.

The disclosed construction of the bolt socket BS as described hereinabove covers up the protective cup 26 with the double walled plastic and furthermore discourages theft of the warning light WL. This construction also increases the depth of the double wall plastic 20D from the center of the bolt to the top of the channelizer to decrease the possibility of the warning light housing 20 rotating within the socket WS and decreasing the possibility of the tearing of the plastic for the socket BS and releasing the warning light in the event of a substantial impact to the device TC. The use of the double wall construction for the socket BS is an improvement over that disclosed in U.S. Pat. No. 4,083,033, since it minimizes the possibility of the tearing of the material at the bolt shank. A further advantage of constructing the socket BS with a double wall as illustrated is that it adds stiffness to the outside wall of the light socket WS thereby minimizing distortion and tearing of the socket WS, as mentioned hereinabove.

With the above structure of the traffic control device TC in mind, the use of the device can be considered in detail. The traffic control device TC may be used with or without warning lights WL or with one or two warning lights. The traffic control device TC is preferably positioned to face the traffic with the arcuate portions 10 of the device TC facing the oncoming traffic to give the device TC its best target value. If the device TC receives a substantial impact from a motor vehicle MV, the device TC will respond by causing the flexible fingers 11 and 12 to release the ballast B therefrom and move in response to the imparted energy off its vertical position to a horizontal position adjacent the released ballast B which remains approximately in the location that the traffic control device TC was originally placed. The traffic control device TC once it is released from the ballast B will dissipate the energy of the impact and because of the weight of the ballast B will initially retard the movement of the traffic control device TC so that it travels from its original position until the energy is expended in releasing the ballast B from the traffic control device TC. The distance the traffic control device TC travels is dependent upon whether or not the warning light WL has been secured thereto. The device TC will travel further from the point of impact when the warning light WL is secured thereto than when the light is not secured thereto as a result of the increased mass of the device. The relationship of the ballast B and the traffic control device TC after a substantial impact of the type described is illustrated in FIG. 2. Once the ballast B is released from the flap elements 11 and 12, the flaps will return to their original condition with a minimum of bending or tearing. In the event the traffic device TC is subjected to a minor impact, the device will not respond to release the ballast B and will merely be moved or rocked in accordance with the strength of the impact.

It will be recognized that with the open topped traffic control device TC, the ballast B may be readily dropped through the open top to rest on the closed end comprised of the flaps 11 and 12. In the same fashion if it is desired to relocate the traffic control device TC, the user may merely grasp the top of the traffic control device TC and pull it along the road surface to the desired position without the need for assembling and reassembling the device as may be necessary in a two-piece traffic control device.

A further advantageous feature of the present invention is the ability to stack the devices TC including stacking the devices without causing the flaps 11 and 12 to be bent and then to take a set. By providing the flexible flaps 11 and 12 at the smaller end of the traffic control device, the devices can be stacked without bending the flap elements 11 and 12 either during stacking or during storage. It should be recognized that if the flap elements were arranged at the top or the larger end of the device and the larger end were mounted on the ground, that in stacking the elements, the flap elements will necessarily be bent to be moved out of the way of the stacked traffic control element and because they are constructed of plastic, tend to take a set under such conditions. If the flaps are "set" or bent upwardly, the device TC may be rendered useless for the intended purpose.

Figure 5:
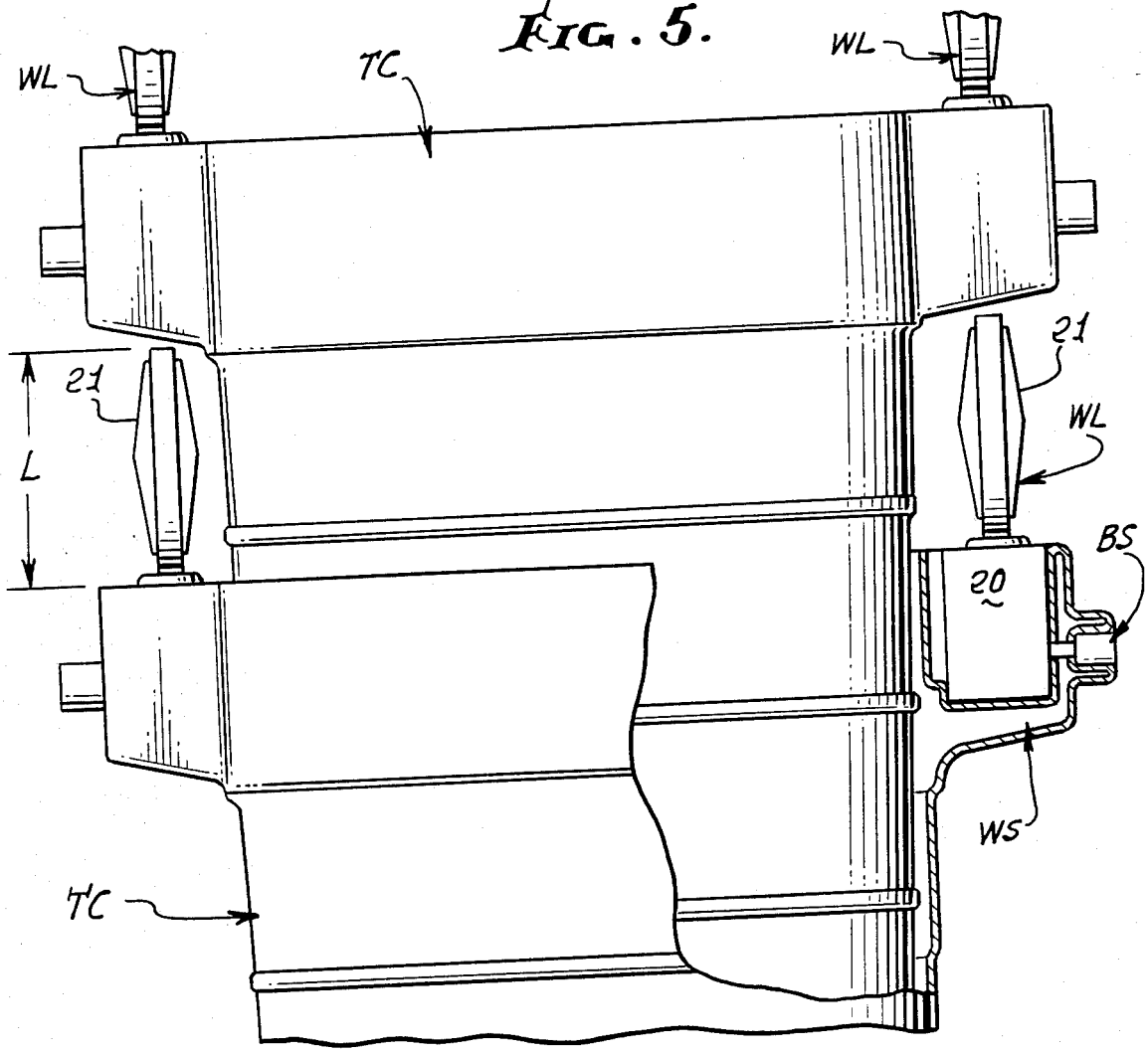
FIG. 5 is a partial, front elevational view, with portions broken away and illustrated in section, of a plurality of traffic control elements having warning lights mounted thereon and with the warning light rotated to a storage position and arranged in a stacked nested relationship.

The traffic control devices TC with the warning lights WL removed therefrom are illustrated in FIG. 6 in a stacked relationship. It will be noted that the smaller diameter end of the traffic control device TC is readily inserted into the larger diameter end of a traffic control device TC so that the topmost traffic control device fits essentially wholly within the receiving traffic control device so as to only expose approximately the vertical distance of one band 10 of the topmost traffic control device TC. Similarly, with the lights mounted in the traffic control devices TC they may be stacked as illustrated in FIG. 5. The warning lights WL are conventionally constructed to permit the lens 21 to be rotated relative to the housing 20. In FIGS. 1, 2, and 3 the lens 21 is illustrated in its in-use position so that an approaching motorist will see the front face of the lens 21. For storage purposes, the lens 21 is rotated 90 degrees, as illustrated in FIG. 5. With this arrangement and with the construction of the light wells WS, only the vertical height L, corresponding essentially to the vertical height of the lens 21 for the warning light WL, will extend outwardly of the top of the traffic control device TC receiving the topmost device and thereby the stacking requires slightly more room than with the lights removed. The ability, however, to stack the traffic control devices TC with the warning lights WL simplifies the stacking and reduces the amount of time required since the labor required to dismount and reassemble the warning lights WL is not required. In stacking the traffic control devices TC, it will be appreciated that because of the provision of the flexible flaps at the smaller diameter end of the traffic control devices, that the flaps will not engage the wall of the stacked traffic control device TC and will maintain its normal horizontal position without effecting the flaps whatsoever, as illustrated in the cross-sectional portion of FIG. 6.

Now referring to FIGS. 10 through 13, the traffic control element TC of FIGS. 1 through 9 is illustrated as the element may be modified in accordance with the presently preferred embodiment for the warning light sockets WS' for mounting warning lights WL. The basic construction of the traffic control element TC of FIGS. 1 through 9 is the same as for the embodiment illustrated in FIGS. 10 through 13, except that the element TC has been modified in accordance with the changes required to accommodate the embodiment of the warning light sockets WS'. The reference characters, then, for the basic embodiment are carried forward to the embodiment of FIGS. 10 through 13.

The warning sockets WS' for the traffic control element TC have been constructed and defined to reduce the manufacturing costs of the traffic control element and improve the method of attachment of the warning lights WL to the traffic control element TC. The warning light sockets WS', as illustrated in FIGS. 10 through 13, has the advantageous feature of the previously described warning light socket WS that prevents the warning light WL from rotating about its mounting bolt axis when mounted to the outside of the traffic control element TC. The warning light sockets WS' are less expensive to manufacture because less plastic is required to manufacture the traffic control element utilizing such warning light sockets WS' than the sockets WS described hereinabove. This also reduces the physical size of the traffic control element TC for shipping and storage purposes, as well. As in the previous embodiment, the warning light sockets WS' are constructed, defined and arranged on opposite sides of the traffic control device T on the outside of the arcuate surfaces thereof, and therefore includes the anti-rolling advantages described hereinabove relative to locating the warning light sockets at this position of the traffic control elements TC.

The warning light sockets WS' basically consist of three, external doubled walled shelves for mounting the warning light WL. The three double walled shelves that are constructed integrally with the traffic control element TC are identified in the drawings as the horizontal shelf 30 for receiving and mounting the warning light WL thereon, and the vertical shelves 31 and 32 mounted on opposite sides and in a spaced apart relationship with the horizontal shelf 30. The horizontal shelf 30 is defined a preselected distance down from the top of the element TC and extends outwardly therefrom. In a typical application the shelf 30 may be approximately 6.75 inches in length and extend approximately 2.00 inches outwardly from the element TC, as illustrated in the drawings. The shelves 31 and 32 are spaced a preselected distance from each end of the shelf 30 and extend approximately 4.0 inches above the top surface of the shelf 30. The shelves 31 and 32 extend outwardly from the element TC approximately the same distance as the shelf 30. The shelves 31 and 32 function as impact protective barriers to minimize damage to the warning light WL and to prevent a warning light WL, mounted on the shelf 30 and secured to the element TC by a mounting bolt 25, from rotating about the bolt 25 when the traffic control element TC is impacted by a motor vehicle, as described hereinabove. The provision of the shelves 30, 31 and 32 add significant stiffness to the light mounting area of the traffic control element TC.

Figure 10:
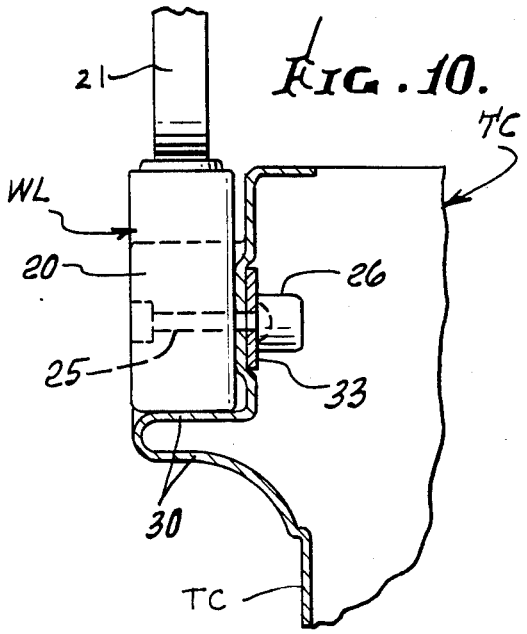
FIG. 10 is a partial, cross-sectional view of the traffic control device of FIGS. 1–9 and illustrating another embodiment of the light holding means and illustrating a portion of a warning light, in elevation, secured thereto.
Figure 12:
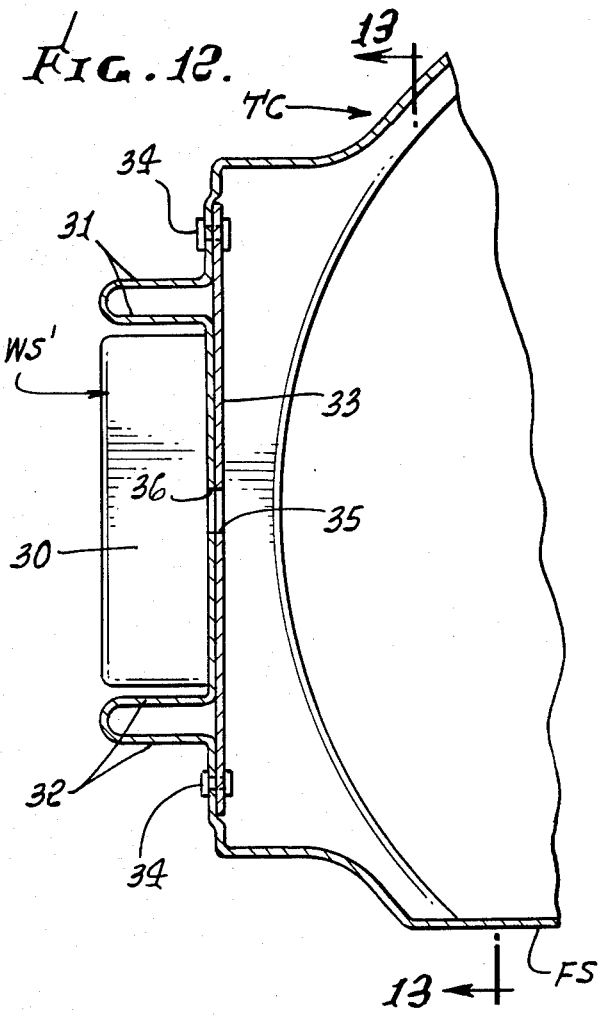
FIG. 12 is a cross-sectional view taken along the line 12—12 of FIG. 11.
Figure 13:
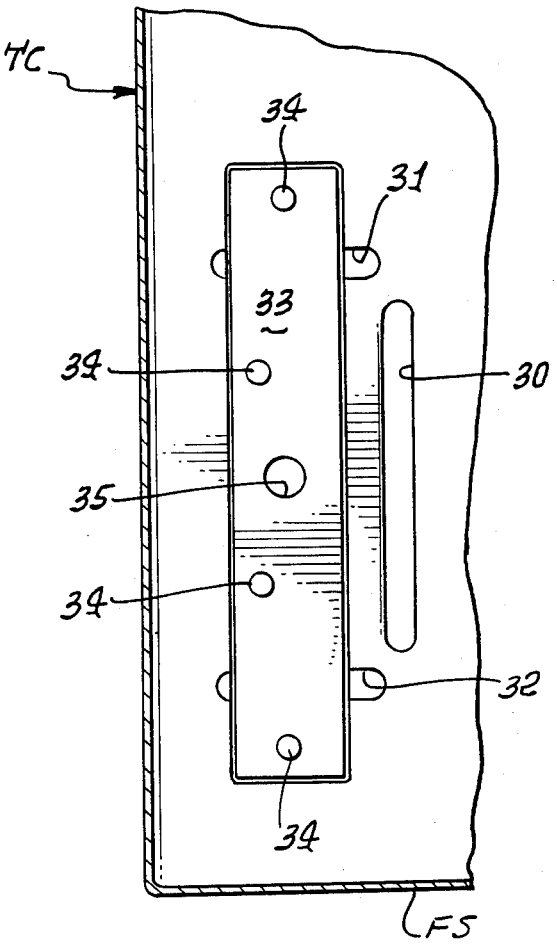
FIG. 13 is a cross-sectional view taken along the line 13—13 of FIG. 12.

In order to significantly improve the attachment of the warning light WL to the traffic control element TC, a reinforcing element 33 is provided and is illustrated as a piece of galvanized steel plate secured to the channelizer TC proper by conventional fastening elements 34. The reinforcing member or galvanized steel plate 33 is approximately 11.50 inches long, 2.00 inches wide and 0.017 inches thick and is riveted to the traffic control element TC by four $\frac{1}{8}''$ rivets 34, as best appreciated from examining FIG. 13. The provision of the reinforcing element 33 to the traffic control element TC has been found to add stability and strength, tear through resistance, to the conventional mounting bolts 25 for the warning light WL secured onto the shelf 30 thereby. For this purpose, the reinforcing plate 33 is provided with an aperture 35 that is coaxial with the aperture 36 provided for the traffic control element TC proper for receiving and securing a mounting bolt 25 to the conventional housing 20 for the warning light WL, as can best be appreciated by examining FIG. 10. As illustrated in FIG. 10, the mounting bolt 25 is provided with the bolt protecting cup 26, as described in the prevous embodiments. The mounting bolt 25 is secured to the housing 20 by inserting it through the apertures 35 and 36 from the inside of the traffic control element TC and then provided with the anti-theft bolt protector 26.

Since the three shelves 30, 31 and 32 are arranged in a spaced apart relationship, and the horizontal shelf 30 is open on the side opposite to the traffic control element TC warning lights WL of varous sizes can be secured to the traffic control element without any problems, as contrasted with the embodiment described hereinabove wherein the warning light socket WS is a closed configuration. The reinforcing member 33 may have the rivets therefor secured along with a flat washer on the outside face of the traffic control element TC. The washers are not illustrated in FIGS. 10 through 13. Any other convenient, conventional method of securing the reinforcing plate 33 to the traffic channelizer TC may also be utilized. When the warning light WL is secured to the traffic channelizer TC, as illustrated in FIG. 10, the reinforcing plate 33, acting in concert with the warning light mounting bolt 25, prevents the light from being torn out of the channelizer TC proper in response to the impact from the motor vehicle. This arrangement provides the necessary anti-rotation to the mounting bolt 25 in response to the impact of the motor vehicle as described hereinabove.

It should now be appreciated by those skilled in the art that the present invention has provided an improved traffic control device TC constructed of one piece that also has the advantageous feature of the breakaway two-piece device, but may be constructed with further advantages and inexpensively from that of a two-piece device.

We claim:

1. A traffic control device comprising a hollow element having a substantially closed end for mounting the element in a vertical position on a mounting surface when functioning as a traffic control element, the closed end being constructed and defined by means of a plurality of flexible flaps for releasably storing ballast means for stabilizing the hollow element in said vertical position when mounted on the flaps, the flaps being further characterized as being responsive to an impact to the hollow element causing it to be moved from its vertical position to permit any ballast means stored on said flaps to substantially remain in position while being separated from the moving hollow element.

2. A traffic control device as defined in claim 1 wherein the hollow element is constructed and defined with at least one flat side so that when the element is impacted to a horizontal position it will render the element roll resistant.

3. A traffic control device as defined in claim 1 wherein the hollow element is constructed and defined with an outer configuration to be roll resistant.

4. A traffic control device as defined in claim 1 wherein the flexible flaps are each constructed and defined integrally therewith to extend from adjacent the outer periphery of the closed end towards the center of said end; each flap being spaced apart by slots extending between adjacent flaps from a central aperture for said end to adjacent the outer periphery whereby each inner end of each flap is spaced from each other flap's inner end to permit each flap to be independently flexible.

5. A traffic control device as defined in claim 4 wherein each flap is further constructed and defined to be raised upwardly on the top side thereof a preselected distance adjacent the outer periphery of said closed end and sloping downwardly toward the free end of the flap for defining a pocket on the bottom side of the flap.

6. A traffic control device as defined in claim 4 wherein each of the slots separating the adjacent flaps are defined to minimize tearing between the flaps.

7. A traffic control device as defined in claim 5 wherein each of said slots comprise a large radiused aperture adjacent the inner end of said slots.

8. A traffic control element as defined in claim 5 wherein each of the slots separating the adjacent flaps are provided with an enlarged opening adjacent the inner ends thereof.

9. A traffic control element as defined in claim 5 wherein the flaps are further characterized as being capable of maintaining their position without drooping when unsupported or taking a set when displaced from or flexed from its normal position.

10. A traffic control device as defined in claim 9 wherein said hollow element and flaps are constructed integrally of a resilient plastic material.

11. A traffic control element comprising a hollow element having an outer configuration that is constructed and defined to be of a stepped configuration from one end to the opposite end thereof to thereby allow a plurality of the elements to be stacked in a nesting relationship, the hollow element having a substantially closed end for mounting it in a vertical position with a mounting surface to function as a traffic control element, the closed end being constructed and defined with a plurality of flexible, segmented flap elements constructed with the hollow element for substantially closing said end of the hollow element, the segmented elements being adapted to receive ballast means for stablizing the hollow element when the hollow element is arranged in said vertical position, the flexible, segmented flap elements being further characterized as being responsive to a substantial impact to the hollow element so as to permit any ballast means mounted thereon to be separated therefrom while causing the hollow element to be moved in response to a substantial impact from its vertical traffic controlling position.

12. A traffic control element as defined in claim 11 wherein the hollow element has at least one flat side so that when the element is impacted to a horizontal position it will prevent the element from readily rolling.

13. A traffic control element as defined in claim 11 or 14 wherein the hollow element is constructed and defined from a flexible material.

14. A traffic control element as defined in claim 11 wherein the segmented flaps and the hollow element are constructed and defined of a flexible plastic material integral with one another.

15. A traffic control element as defined in claim 11 wherein the flap elements are constructed and defined to be sufficiently rigid to maintain their normal extended position including when said elements are unsupported.

16. A traffic control element as defined in claim 11 wherein the flap elements are constructed and defined with an integral pocket for each element to maintain them in a substantially horizontally extended position including when said elements are unsupported.

17. A traffic control element as defined in claim 11 including means constructed and defined for mounting a warning light to the hollow element.

18. A traffic control element as defined in claim 11 including means constructed and defined on the outside surface of the hollow element and adjacent the top surface thereof for mounting a warning light to the hollow element and to permit a plurality of the elements to be stacked in a nesting relationship including when a warning light is mounted thereto.

19. A traffic control device as defined in claim 18 wherein the hollow element and the warning light mounting means are integrally constructed of a plastic material, said mounting means comprising shelf means for receiving and supporting a warning light thereon and adapted to permit the warning light to be secured to the hollow element when supported by the shelf means, the shelf means being further characterized as being defined to retain a warning light in a non-rotatable position including when the hollow element has responded to a substantial impact causing it to rest in a substantially horizontal position.

20. A traffic control element as defined in claim 18 wherein said warning light mounting means is constructed and defined to receive a warning light having a housing with a lens-light system extending upwardly therefrom, the mounting means being defined with a depth to substantially enclose the warning light housing therein to thereby minimize any relative motion between the light mounting means and the warning light.

21. A traffic control element as defined in claim 20 wherein the hollow element and the warning light mounting means are integrally constructed of a plastic material and defined with a plastic socket for receiving a warning light mounting means therein to secure the warning light to said mounting means.

22. A traffic control element as defined in claim 21 wherein the light mounting means is defined by a double plastic wall for the outer wall of the mounting means and including a double walled plastic socket defined integrally with said outer wall for receiving a warning light mounting bolt within the thus defined socket.

23. A traffic control element as defined in claim 22 wherein said plastic socket is constructed and defined to receive a warning light mounting bolt in combination with a bolt protective means in an anti-theft relationship whereby a mounting bolt and bolt protective means securing a warning light are substantially enclosed within the plastic socket.

24. A traffic control element as defined in claim 11 wherein the hollow element has a stepped configuration wherein the smaller dimension of the element has said closed end and the larger dimension of the element is at the free end to thereby allow a plurality of the thus defined elements to be stacked in a nesting relationship.

25. A traffic control element as defined in claim 24 wherein the hollow element has an outer configuration to be roll resistant.

26. A traffic channelizer comprising a hollow element having an outer configuration that is constructed and defined to be of a stepped configuration from one end to the opposite end thereof, the smaller dimension of the stepped hollow element having a substantially closed end for mounting the element in a vertical channelizing position with a mounting surface, said closed end being constructed and defined with a plurality of spaced, flexible elements constructed integrally with the hollow element for substantially closing said end of the hollow element, the flexible elements being adapted to receive means for stabilizing the element in said vertical position and being responsive to a substantial impact to the hollow element so as to release any stabilizing means therefrom while permitting the hollow element to be moved from its vertical position while being separated from the stabilizing means, and means constructed and defined for mounting a warning light to the hollow element adjacent the top side thereof.

27. A traffic channelizer as defined in claim 26 wherein the spaced, flexible elements of the closed end are constructed and defined integrally with the hollow element to extend inwardly from adjacent the outer periphery of the closed end towards the center thereof, each flexible element being spaced apart by radial slots extending between adjacent elements from adjacent the outer periphery of the closed end to a central aperture whereby the inner end of each element is spaced from the ends of each other element to permit each element to be independently flexible of the other elements.

28. A traffic channelizer as defined in claim 27 wherein each element is further constructed and defined to have a configuration for maintaining the elements in a substantially rigid horizontal position including when removed from a supporting surface.

29. A traffic channelizer as defined in claim 28 wherein each element is constructed and defined to be raised upwardly on the top side of the element as preselected distance adjacent the outer periphery of the closed end and sloping downwardly toward the free end of the element and thereby defining a pocket on the bottom side of the element.

30. A traffic control element as defined in claim 29 wherein each of the slots separating the adjacent flaps are provided with an enlarged opening adjacent the inner ends thereof.

31. A traffic control element as defined in claim 28 wherein the flaps are further characterized as being capable of maintaining their position without drooping when supporting or taking a set when displaced from or flexed from its normal position.

32. A traffic channelizer as defined in claim 26 wherein said warning light mounting means is constructed on the outside of the hollow element to permit a plurality of said elements to be stacked in a nested relationship including when the warning light is mounted in the light mounting means.

33. A traffic channelizer as defined in claim 32 wherein the warning light mounting means is defined to retain a warning light in a nonrotatable position including when the hollow element has responded to a substantial impact.

34. A traffic channelizer as defined in claim 27 wherein the element is constructed of a resilient plastic material.

35. A traffic channelizer as defined in claim 34 wherein the hollow element includes a plurality of bands secured in a spaced apart relationship on the element, each of the bands being of a color selected to contrast with the color of the element.

36. A traffic channelizer as defined in claim 35 wherein the bands comprise light reflective bands.

37. A traffic channelizer as defined in claim 32 wherein the warning lights mountable to said light mounting means comprises a housing having a lens mounted on top thereof, the housing being substantially received in the light mounting means with the lens extending outwardly from the mounting means from a point adjacent the top of the mounting means.

38. A traffic channelizer as defined in claim 26 wherein the hollow element is constructed and defined with at least one flat side so that when the element is impacted to a horizontal position it will render the element roll resistant.

39. A traffic channelizer as defined in claim 26 or 28 wherein the outer configuration of the hollow element is an arcuate configuration with at least one flat side.

40. A traffic channelizer as defined in claim 29 wherein the outer configuration of the hollow element provides a continuous high target value and a roll resistant surface.

41. A traffic channelizer as defined in claim 32 wherein the outer configuration of the hollow element is an arcuate configuration with at least one flat side and the warning light mounting means is constructed on the outside of the arcuate portion of the hollow element to further restrict the rolling of the hollow element when the element is impacted to a horizontal position.

42. A traffic channelizer as defined in claim 18 wherein the warning light mounting means is constructed and defined to also function to render the hollow element roll resistant when the device is impacted to a horizontal position.

43. A traffic channelizer as defined in claim 18 wherein the hollow element has an outer configuration that is arcuate with at least one flat side and the warning light mounting means being defined on the arcuate portion, the warning light mounting means being constructed and defined to render the hollow element roll resistant when the device is impacted to a horizontal position.

44. A traffic control device comprising a hollow element having a substantially closed end for mounting the element in a vertical position on a mounting surface when functioning as a traffic control element, the closed end being constructed and defined by means of a plurality of flexible flaps for releasably storing ballast means for stabilizing the hollow element in said vertical position when mounted on the flaps, the flaps being further characterized as being responsive to an impact to the hollow element causing it to be moved from its vertical position to permit any ballast means stored on said flaps to substantially remain in position while being separated from the moving hollow element, and means constructed and defined for mounting a warning light to the hollow element in a non-rotatable position including when the hollow element has responded to a substantial impact.

45. A traffic control device as defined in claim 44 wherein said warning light mounting means comprises shelf means for receiving and supporting a warning light thereon and adapted to permit the warning light to be secured to the hollow element when supported by the shelf means.

46. A traffic control device as defined in claim 45 wherein said shelf means comprises a warning light supporting shelf defined integral with the hollow element, the supporting shelf being oriented in a substantially horizontal plane when the hollow element is mounted in a vertical position, said shelf means comprising a pair of substantially vertical walls relative to said horizontal shelf arranged on opposite sides of said horizontal shelf means and being constructed and defined to extend outwardly from the adjacent wall of the hollow element to retain a warning light therebetween.

47. A traffic control device as defined in claim 46 wherein the warning light comprises a housing adapted to be secured to an object by means of a mounting bolt and said hollow element being provided with an aperture for receiving a mounting bolt therein.

48. A traffic control device as defined in claim 44 wherein the hollow element is constructed and defined with at least one flat side so that when the element is impacted to a horizontal position it will render the element roll resistant.

49. A traffic control device as defined in claim 44 wherein the hollow element is constructed and defined with an outer configuration to be roll resistant.

50. A traffic control device as defined in claim 44 wherein the flexible flaps are each constructed and defined integrally therewith to extend from adjacent the outer periphery of the closed end towards the center of said end; each flap being spaced apart by slots extending between adjacent flaps from a central aperture for said end to adjacent the outer periphery whereby each inner end of each flap is spaced from each other flap's inner end to permit each flap to be independently flexible.

51. A traffic control device as defined in claim 50 wherein each flap is further constructed and defined to be raised upwardly on the top side thereof a preselected distance adjacent the outer periphery of said closed end and sloping downwardly toward the free end of the flap for defining a pocket on the bottom side of the flap.

52. A traffic control device as defined in claim 51 wherein each of the slots separating the adjacent flaps are defined to minimize tearing between the flaps.

53. A traffic control device as defined in claim 52 wherein each of said slots comprises a large radiused aperture adjacent the inner end of said slots.

54. A traffic control element as defined in claim 53 wherein each of the slots separating the adjacent flaps are provided with an enlarged opening adjacent the inner ends thereof.

55. A traffic control element as defined in claim 52 wherein the flaps are further characterized as being capable of maintaining their position without drooping when unsupported or taking a set when displaced from or flexed from its normal position.

56. A traffic control device as defined in claim 55 wherein said hollow element and flaps are constructed integrally of a resilient plastic material.

57. A traffic control device as defined in claim 19 wherein said shelf means comprises a warning light supporting shelf defined integral with the hollow element, the supporting shelf being oriented in a substantially horizontal plane when the hollow element is mounted in a vertical position, said shelf means comprising a pair of substantially vertical walls relative to said horizontal shelf arranged on opposite sides of said horizontal shelf means and being constructed and defined to extend outwardly from the adjacent wall of the hollow element to retain a warning light therebetween.

58. A traffic control device as defined in claim 57 wherein the warning light comprises a housing adapted to be secured to an object by means of a mounting bolt securable thereto and said hollow element is provided with an aperture for receiving a mounting bolt therein to be secured to the warning light.

59. A traffic control device as defined in claim 58 wherein said mounting means includes means secured to the hollow element for reinforcing said hollow element at said mounting means.

60. A traffic control device as defined in claim 57 wherein said pair of vertical walls are arranged on opposite ends of the supporting shelf in a preselected spaced relationship with said ends.

61. A traffic control device as defined in claim 60 wherein the warning light comprises a housing adapted to be secured to an object by means of a mounting bolt and said hollow element is provided with an aperture for receiving a mounting bolt therein, and reinforcing plate means secured to said hollow element on the opposite side of the hollow element from said shelf means, said reinforcing plate means being provided with an aperture defined coaxially with said aperture for the hollow element for receiving a mounting bolt therein.

62. A traffic control device as defined in claim 61 wherein said mounting bolt includes bolt protective means secured thereto in an anti-theft relationship.

63. A traffic control device as defined in claim 62 wherein the hollow element has a stepped configuration wherein the smaller dimension of the element has said closed end and the larger dimension of the element is at the free end to thereby allow a plurality of the thus defined elements to be stacked in a nesting nesting relationship.

64. A traffic control device as defined in claim 63 wherein the hollow element has an outer configuration constructed and defined to be roll resistant.

65. A traffic control device as defined in claim 64 wherein the outer configuration of the hollow element is an arcuate configuration with at least one flat side and the warning light mounting means is constructed on the outside of the arcuate portion of the hollow element to further restrict the rolling of the hollow element when the element is impacted to a horizontal position.

* * * * *

UNITED STATES PATENT AND TRADEMARK OFFICE

CERTIFICATE OF CORRECTION

PATENT NO. : 4,475,101

DATED : October 2, 1984

INVENTOR(S) : Jack H. Kulp and Richard M. Cunningham

It is certified that error appears in the above-identified patent and that said Letters Patent is hereby corrected as shown below:

Col. 1, line 47, delete "uses" and substitute -- users --.

Col. 3, line 24, delete "in" and substitute -- to --.

Col. 4, line 38, delete "aftwer" and substitute -- after --.

Col. 5, line 35, delete "end" and substitute -- and --.

Col. 6, line 40, delete "releaf" and substitute -- relief --.

Col. 7, line 10, delete "ae" and substitute -- are --.

IN THE CLAIMS:

Claim 13, col. 12, line 45, delete "14" and substitute -- 12 --.

Claim 31, col. 14, line 34, delete "supporting" and substitute -- unsupported --.

Signed and Sealed this

Fifth Day of April, 1988

*Attest:*

*Attesting Officer*

DONALD J. QUIGG

*Commissioner of Patents and Trademarks*